US007000626B1

(12) United States Patent
Cress

(10) Patent No.: US 7,000,626 B1
(45) Date of Patent: Feb. 21, 2006

(54) INSTANTANEOUS AND CONSTANT FLUID DELIVERY SYSTEM

(76) Inventor: Steven B. Cress, P.O. Box 30, Glenbrook, NV (US) 89413

( * ) Notice: Subject to any disclaimer, the term of this patent is extended or adjusted under 35 U.S.C. 154(b) by 0 days.

(21) Appl. No.: 10/683,475

(22) Filed: Oct. 8, 2003

(51) Int. Cl.
*F16L 37/00* (2006.01)

(52) U.S. Cl. ..... 137/1; 137/337; 137/565.15; 137/565.16; 126/362; 417/12

(58) Field of Classification Search ..... 137/334, 137/337, 563, 565.15, 565.16; 126/362; 417/12
See application file for complete search history.

(56) References Cited

U.S. PATENT DOCUMENTS 2,971,532 A * 2/1961 McLaren et al. ..... 137/592
3,229,683 A * 1/1966 Russell et al. ..... 122/14.31
3,688,839 A * 9/1972 Kirschner et al. ..... 165/108
4,142,515 A * 3/1979 Skaats ..... 122/13.3
4,750,472 A * 6/1988 Fazekas ..... 122/13.3
4,917,142 A * 4/1990 Laing et al. ..... 137/337
5,105,846 A * 4/1992 Britt ..... 137/337
6,000,424 A * 12/1999 Christopher et al. ..... 137/337

* cited by examiner

*Primary Examiner*—A. Michael Chambers
(74) *Attorney, Agent, or Firm*—Herbert C. Schulze

(57) ABSTRACT

This is a method and means for maintaining a constant supply of a fluid with specific characteristics within a fluid supply conduit from a supply source of the fluid with specific characteristics at a point of service of the fluid with specific characteristics in which a first open end of a recirculation conduit is located within the fluid with specific characteristics supply conduit adjacent the point of service. A second end of the recirculation conduit is connected to pump means in such manner that a portion of the fluid with specific characteristics within the fluid with specific characteristics supply conduit adjacent the point of service is constantly circulated back.

In an alternate embodiment a similar recirculation conduit is utilized in a manner to prevent freezing of conduits in a total fluid supply line which includes portions in relatively warm areas and in areas subject to freezing.

4 Claims, 4 Drawing Sheets

INSTANTANEOUS AND CONSTANT FLUID DELIVERY SYSTEM

BACKGROUND OF THE INVENTION

I. Field of the Invention

This invention is in the general field of fluid delivery systems;

The invention is more particularly in the field of fluid delivery systems for commercial, residential, and industrial buildings;

The invention is most particularly in the field of fluid delivery systems which provide fluid at a point of use which has instantaneous control of characteristics of the fluid being delivered for use at a point of service.

II. Description of the Prior Art

I am familiar with existing water systems directed at assuring that a characteristic of the water, particularly, but not necessarily exclusively the temperature is always immediately available at points of use such as a wash basin, shower, kitchen sink, and the like. These systems are generally of two types.

In one type is an instantaneous hot water system a high power water heating device is located directly at a point of use and so configured as to immediately heat cold water coming from a supply line at the point of use. Such systems can be difficult to install and costly, particularly in existing buildings and the like.

The second system for providing temperature control such as instantaneous hot water at a point of use is the installation of a small size conduit along side a main hot water supply line, connected to the main hot water supply line adjacent the point of use and running along side the main hot water supply line back and into to a hot water storage tank with a pump provided to establish a constant recirculation of a small amount of hot water in order to maintain the availability of hot water at the point of use during times when the hot water is not being used. These systems are difficult and costly when installed in existing buildings which previously had no such system.

I have searched literature, available commercial products, and patent data and have found no prior art which incorporates or suggests the new, novel, unique, and useful characteristics of my present invention which is described below.

SUMMARY OF THE INVENTION

It is frequently desirable to have instantaneous flow of hot water for bathing, dish washing, and many other purposes. Frequently this is not possible as many water heaters and tanks of hot water are located at some distance from the points of use of hot water. When the hot water stands in the supply line from a hot water tank of the like for some period of time it cools, and when a valve or the like is opened at the point of use all of the cooled water in the line must pass through before hot water appears for use.

I have described above the system used in some installations where a return recirculation line is provided alongside a main hot water supply system. In many buildings it may be very costly to attempt to install such systems since it may require extensive structural alteration and the like as is known to those skilled in the art.

After considerable thought and work I have now conceived and developed an inexpensive system to achieve the desired result of providing water having constant and instantaneous characteristics such as hot water at points of use without the necessity of the expense and inconvenience of providing the recirculation arrangements existing prior to my present invention. I have accomplished this by a new, unique, novel, and useful system of installation of a recirculation line from a point of use of hot water to a hot water tank within an existing hot water supply conduit. It is to be noted that throughout this document I may refer primarily to hot water, the characteristic being temperature. However, this invention is also of use where it is desired to maintain other water or other fluid characteristics. For example, it may be desired to maintain a certain level of chlorine in a water system. However, when a line is idle for some time the chlorine level within the line can diminish.

It is object of this invention to provide a system for constant and instantaneous delivery of fluid having specific characteristics at points of use or service of the fluid without extensive structural or plumbing alterations;

Another object of this invention is to provide an enhanced system for instantaneous deliver of fluid with desired characteristics, such as temperature or the like at points of use of the water.

Another object of this invention is to provide an inexpensive system of delivery of fluid to points of use of the fluid wherein characteristics of the fluid will remain uniform through an entire fluid system;

Another object is to assure that fluid delivered to a point of use in a water system will always be delivered with consistent characteristics.

The foregoing and other objects and advantages of this invention will become apparent to those skilled in the art upon reading the following description of a preferred embodiment in conjunction with a review of the appended drawings.

DESCRIPTION OF A PREFERRED EMBODIMENT

Figure 1:
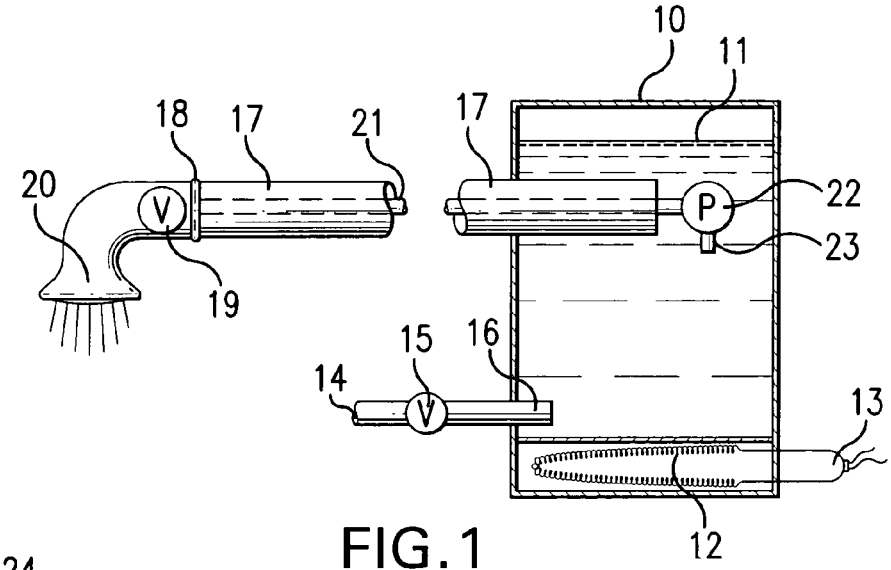
FIG. 1 is a schematic diagram of an instantaneous hot water system suitable to practice the method of this invention.

An inventory of items bearing reference numerals on the drawings is:

| Numeral | Item |
|---|---|
| 10 | water heater tank |
| 11 | water level |
| 12 | heating elements |
| 13 | power for heating elements |
| 14 | water intake |
| 15 | valve |
| 16 | water inlet into tank |
| 17 | hot water supply conduit |
| 18 | coupling |

-continued

| Numeral | Item |
|---|---|
| 19 | valve |
| 20 | shower head |
| 21 | recirculation conduit |
| 22 | reversible submersible pump |
| 23 | pump outlet into tank/inlet to conduit 21 |
| 24 | connector to conduit 21 |
| 25 | connecting link |
| 26 | connector to parachute 27 |
| 27 | parachute or umbrella |
| 117 | hot water outlet |
| 118 | hot water branch outlet |
| 119 | hot water branch outlet |
| 121 | recirculation conduit |
| 122 | recirculation conduit |
| 123 | recirculation conduit |
| 124 | magnetic sleeve |
| 125 | magnet |
| 210 | water heater tank |
| 211 | water level |
| 212 | heating elements |
| 213 | power for heating elements |
| 214 | water intake |
| 215 | valve |
| 216 | water inlet into tank |
| 217 | hot water supply conduit |
| 218 | coupling |
| 219 | valve |
| 220 | shower head |
| 221 | recirculation conduit |
| 222 | pump |
| 223 | pump intake |
| 224 | hot water chamber |

The figs. may be viewed together or independently.

FIG. 1 shows water heater tank 10 with a water level 11. Heater elements 12 are connected to heater power source 13 (this may be electrical, combustible or the like). A source of water 14 provides water through valve 15 and inlet 16 into the tank. Hot water supply conduit 17 extends to coupling 18 where it connects to a valve or the like 19 leading to shower head 20 or the like which will be located in a point of use area such as a bathroom, kitchen sink, washing machine or the like as will be known to those skilled in the art. Recirculation conduit 21 extends from a point near the end of hot water supply conduit 17 through the supply conduit to a reversible submersible pump 22. The pump will have a discharge into the tank/inlet from the tank 23. The reversible pump can operate to suck hot water adjacent the point of service (adjacent valve 19) and return the hot water through conduit 21 into the tank from pump outlet/inlet 23. This causes constant movement of hot water in conduit 17 from the tank to the point of service (in this case shower head 20) thus maintaining an instantaneous flow of hot water through valve 19 when it is open.

Because the pump 22 is pulling part of the water back from the point of service there may be less than full pressure at the shower head. Therefore, when desired the pump 22 can be reversed and it will then force hot water from the tank through conduit 21 where it will mix with the rest of the water in conduit 17 and will cause a slight backflow into the main supply in conduit 17 thus maintaining the system in the condition of always having instantaneous hot water to the shower head at full pressure when valve 19 is opened.

Figure 2:
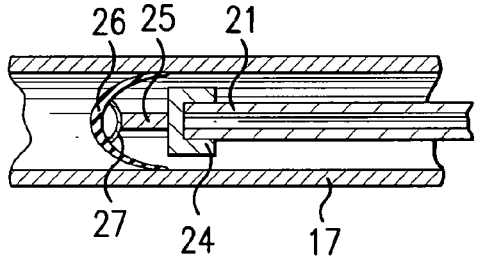
FIG. 2 is a schematic section on a portion of a hot water supply conduit during installation of a recirculation conduit suitable to practice the method of this invention.

FIG. 2 shows a preferred way of threading the recirculation conduit 21 into the conduit 17. The recirculation conduit 21 is a flexible conduit of one of a number of flexible materials known to those skilled in the art. A clamp or the like 24 is connected to an end of a length of flexible conduit 21. A connecting link 25 connects clamp 24 to connector 26 on the interior of a parachute or umbrella like expandable member 27. When the end of the recirculation conduit has been placed in the end of conduit 17 within the hot water tank, the valve 19 may be opened and water will flow from the tank to the shower head 20 or the like. The water pressure will force the parachute or umbrella like member 27 through conduit 17. When the member 27 reaches the area of the coupling 18 the valve 19 will be closed. The coupling is then opened, the parachute or umbrella member is removed from the conduit 21 and the coupling is closed. At the tank, the conduit 21 is cut to the appropriate length and connected to the pump 22. Normal operation of the heater can commence and the recirculation of hot water through conduit 21 will cause the water available to the shower head to remain constantly hot.

Figure 3:
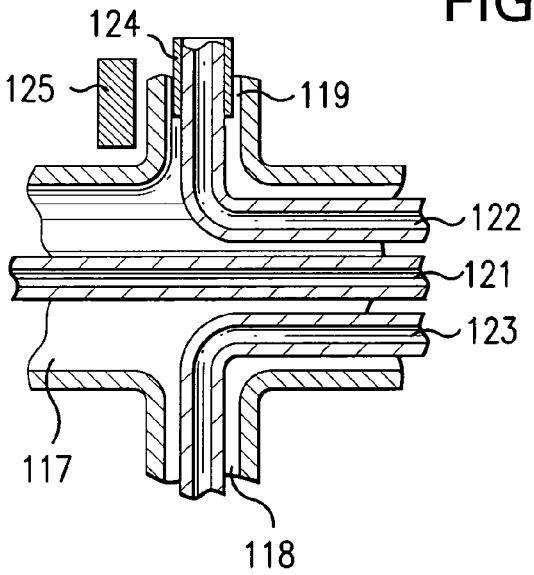
FIG. 3 is a schematic section on a portion of a hot water supply conduit during installation of an alternate recirculation conduit suitable to practice the method of this invention.

FIG. 3 shows the situation where there are multiple points of use of hot water with one hot water tank and one main hot water outlet and branches to points of use. The main hot water conduit 117 from a hot water tank is shown to have two branches 118 and 119. Recirculation lines 121, 122, and 123 are shown in the process of installation. Recirculation conduit 121 will be going within conduit 117 to a point of use (not shown). Recirculation conduits 122 and 123 will be diverted from conduit 117 into branch conduits 119 and 118 respectively. Recirculation conduit 122 is being guided out of conduit 117 and into conduit 119 by a magnetic guiding arrangement. The conduit 122 has a magnetic sleeve 124 about its leading end. A magnetic guiding means 125 such as an electromagnet, bar magnet, or ring magnet or the like will guide conduit 122 into conduit 119 which ultimately ends at a hot water service point. The conduit 122 may also have a parachute or umbrella device similar to the one shown in FIG. 2 (Such device has not been shown in order to avoid confusion with the magnetic guiding arrangement). Similar magnetic guiding and parachute or umbrella devices will exist for conduit 123, but have not been shown in the drawing.

Figure 4:
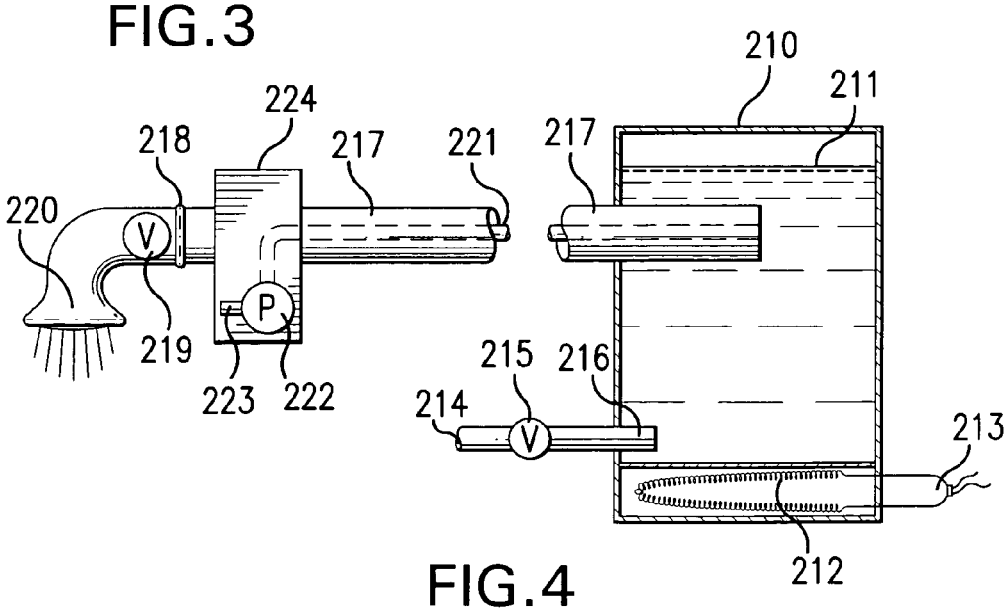
FIG. 4 is a schematic diagram of an alternate embodiment of a recirculation conduit system suitable to practice the methods of this invention.
Figure 5:
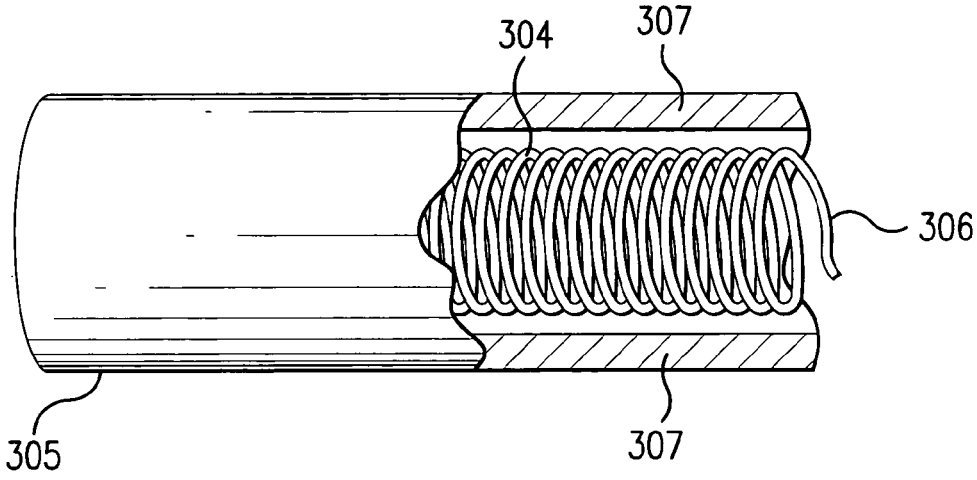
Figure 6:
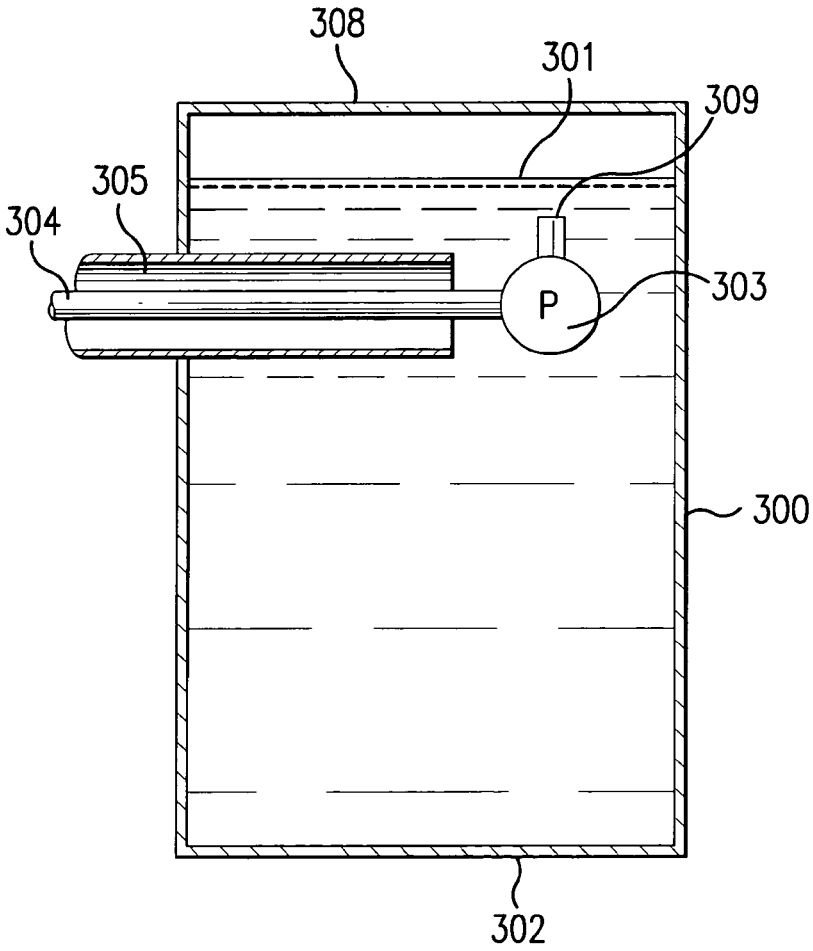
Figure 7:
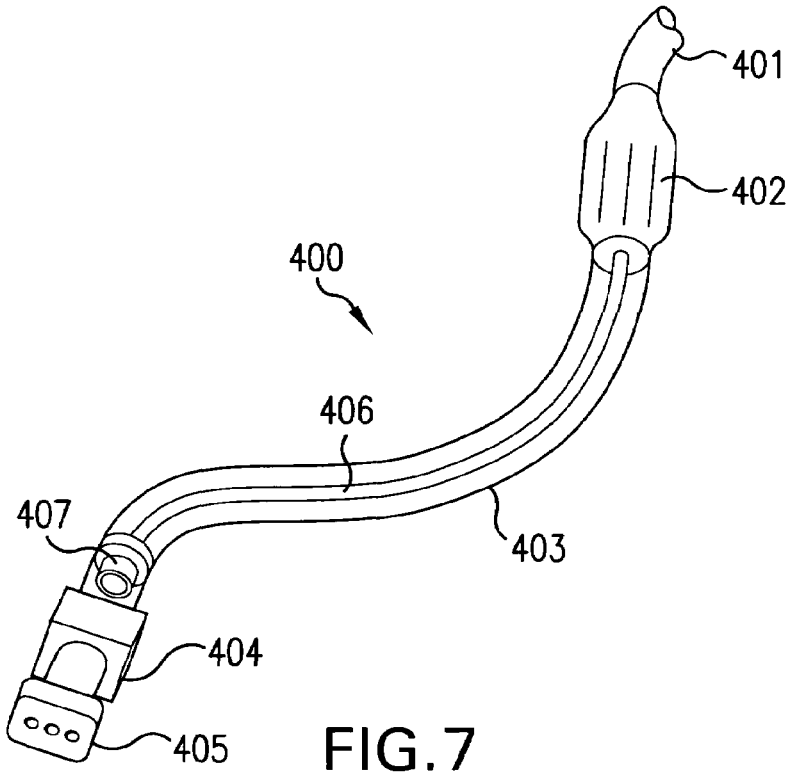
Figure 8:
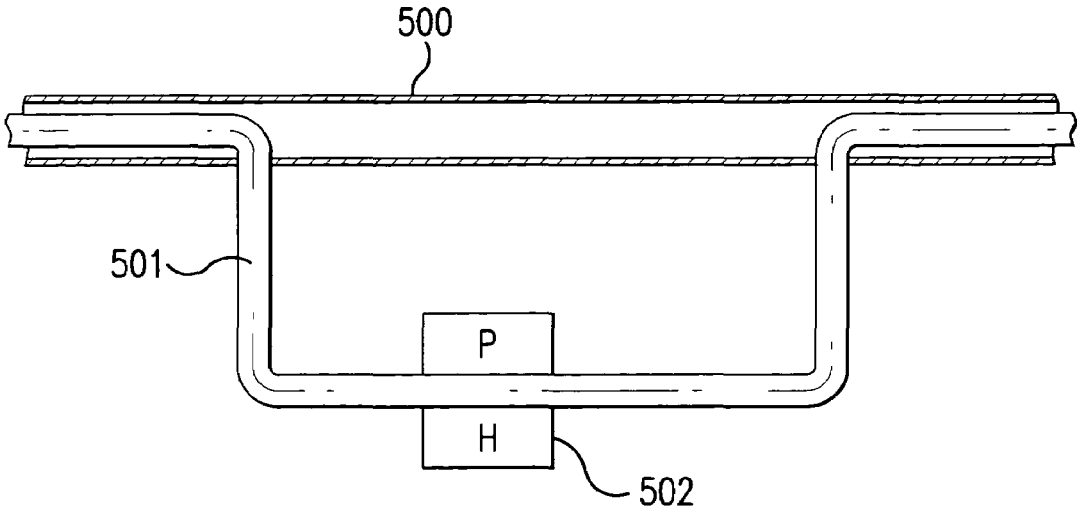
Figure 9:
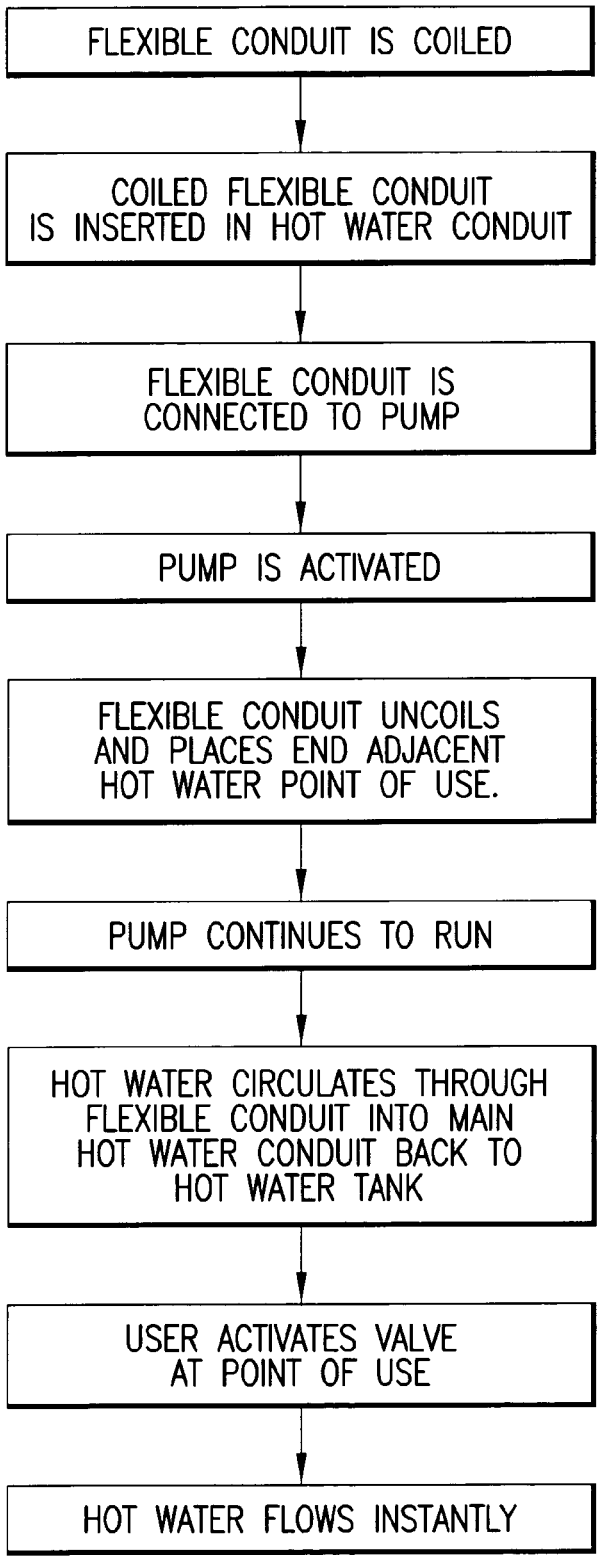

FIG. 4 is an alternate way of doing what was shown and described in FIG. 1. In order for the actions described for FIG. 1 to be effective the flexible recirculation conduit must be non-collapsible since suction is being applied to the conduit, as will be understood by those skilled in the art. Since some may prefer to work with collapsible flexible conduit due to ease of handling, I am showing a preferred way of doing that. In this case the fundamental difference is that the recirculation pump 222 must be at the point of use of hot water and instead of being in the hot water tank, the recirculation pump 224 will be an a small hot water chamber 226. FIG. 4 shows water heater tank 210 with a water level 211. Heater elements 212 are connected to heater power source 213 (this may be electrical, combustible or the like). A source of water 214 provides water through valve 215 and inlet 216 into the tank. Hot water supply conduit 217 extends to hot water chamber 224 and coupling 218 where it connects to a valve or the like 219 leading to shower head 220 or the like which will be located in a point of use area such as a bathroom, kitchen sink, washing machine or the like as will be known to those skilled in the art. Recirculation conduit 221 extends from minature submersible pump 222 located within hot water chamber 224 to hot water tank 210 through the supply conduit 217 to the end of conduit 217 where the recirculation water enters tank 210.

An additional feature of my new invention and system is that by running a flexible conduit inside a cold water line in a building or the like in a cold water conduit freezing of the conduit in extremely cold areas such as a basement, crawl space, or the like can be eliminated. It is unnecessary to illustrate this, since one skilled in the art will understand the principle without the need of an illustration. A water chamber or tank can be provided in a normal hot or cold water line in an area which is normally not subject to the possibility of freezing such as adjacent a normally heated upper level room. A water chamber or tank or the like can also be provided with an inlet and outlet into the water conduit. The water chamber or tank or the like can be independently heated or treated to a predetermined level if desired to provide complete assurance of the integrity of the system. A flexible hose can be run through the conduit for whatever length may be necessary to assure that an end will be in the water conduit in a position not normally subject to freezing. The other end of the flexible conduit will be connected to a submersible pump in the water chamber. With the pump running continuously the water will circulate constantly thus preventing freezing at the most vulnerable areas. In a reversal of the direction of circulation, the water chamber with a submersible pump can be located adjacent in the area which will not normally freeze and end of the flexible conduit terminating in the lowest and/or coldest area of the water line. in which there is a water conduit with. All of the foregoing will be understood by those skilled in the art. While I have made reference to water chambers and submersible pumps, it will be understood by those skilled in the art that an exterior pump with appropriate connections to the flexible conduit and the main water conduits could also be used to accomplish the desired ends. It is the inventor's belief the submersible pumps and the like discussed above are preferable. In either event, the teachings of this invention are the same.

It is intended that a part of this invention will, when a new istallation is being made, include a hot water tank with a pre-installed submersible pump suitable to operate in the manner previously described, and a supply of normal water conduits with pre-installed recirculation conduits, so that in an initial installation the first length of hot water conduit with the interior recirculation conduit in place will be installed to the hot water tank or the like. The second length of hot water conduit will be installed in the following manner: the interior length of recirculation conduit in the second length of hot water conduit will be connected to the interior recirculation conduit in the first length of hot water conduit after which the first and second lengths of hot water conduit are connected together. This procedure will continue for the entire installation, as will be understood by thos skilled in the art.

While I have shown and described one or more ways to move, pull, and guide the recirculation conduits, it is to be understood that I am merely showing one workable way. For example, the movement of the recirculation conduits could be by a plumber's snake inserted into the tank outlet conduit or another way which may occur to one skilled in the art without departing from the teaching of this disclosure. Also, guiding of the recirculation conduits might be accomplished with ultra sonic means or otherwise.

I have referred to "flexible" conduit for the interior conduits of this invention. By the term "flexible" I mean any conduit which can be run inside a main water conduit to accomplish the advantages desired in practicing the methods and constructing the apparatus of this invention. For example if an entire system is in a straight line, it is not necessary for the inner conduit to bend, or curve, or the like. In a system where there might be ninety degree (or even more acute) angles it will be necessary to have easily contorted conduits on the interior. Therefore, in interpreting this document it is to be understood that "flexible conduit" means only that the conduit will be capable of carrying fluids within another condit carrying the similar fluids.

By this reference I restate the claims and abstract which follow as a part of the description of a preferred embodiment at this point the same as though they were repeated at length here.

In the event I fail to claim a properly patentable feature in the claims which follow it shall be due to inadvertence and not due to any desire to dedicate or abandon such feature. Upon learning of any such failure to claim I shall take any proper step to correct the situation.

While the preferred embodiments of this invention shown and described are fully capable of achieving the objects and advantages desired, it is to be understood that such disclosures, teachings, descriptions, and showings are for purposes of illustration only and not for purposes of limitation.

The invention claimed is:

1. A method for maintaining instantly available hot water at a hot water point of service comprising: inserting a recirculation conduit within a hot water supply conduit containing hot water and connected to a supply of hot water within an hot water tank in such manner that a first open end of the recirculation conduit is adjacent the point of service and within hot water; connecting a second end of the recirculation conduit to fluid pumping means; and activating said pumping means in a manner which causes constant circulation of hot water from the point of service to the hot water tank.

2. A method for preventing freezing of water in a water conduit circuit comprising: locating a water recirculation conduit within the water conduit extending from a first warm area to a second coldest area of the water circuit; connecting pumping means to said water recirculation conduit; and activating said pumping means so as to create a constant recirculation of water through the recirculation conduit from the first warm area to the second coldest area and from the second coldest area to the first warm area.

3. A method for maintaining instantly available fluid having constantly uniform characteristics at a fluid point of service comprising: inserting a recirculation conduit within a fluid supply conduit containing fluid with specific characteristics and connected to a supply of fluid with said specific characteristics within a supply of fluid with said specific characteristics in such manner that a first open end of the recirculation conduit is adjacent the point of service and within the fluid; connecting a second end of the recirculation conduit to fluid pumping means; and activating said pumping means in a manner which causes constant circulation of fluid with said specific characteristics from the point of service to the supply of fluid with said specific characteristics.

4. Apparatus for maintaining instantly available hot water at a point of serve comprising: recirculation conduit means within a hot water supply conduit leading from an hot water supply tank to a point of hot water service having a first open end adjacent the point of hot water service and a second end connected to fluid pumping means; and means cooperative with said pumping means to convey hot water from said recirculation conduit means to said hot water supply tank.

* * * * *